United States Patent [19]

Sapkus

[11] Patent Number: 4,580,585

[45] Date of Patent: Apr. 8, 1986

[54] HAIR TWINING APPARATUS

[75] Inventor: Jurgis Sapkus, Manhattan Beach, Calif.

[73] Assignee: Mattel, Inc., Hawthorne, Calif.

[21] Appl. No.: 473,915

[22] Filed: Mar. 10, 1983

Related U.S. Application Data

[63] Continuation of Ser. No. 367,483, Apr. 12, 1982, abandoned.

[51] Int. Cl.[4] ..... A45D 1/00

[52] U.S. Cl. ..... 132/9

[58] Field of Search ..... 132/9, 7

[56] References Cited

U.S. PATENT DOCUMENTS 4,038,996 8/1977 Eronini ..... 132/9

4,307,737 12/1981 Shipman ..... 132/9

4,369,690 2/1983 Sapkus ..... 132/9

*Primary Examiner*—Gregory E. McNeill

*Attorney, Agent, or Firm*—Ronald M. Goldman; Melvin A. Klein

[57] ABSTRACT

A hand-held, hand operated hair twining apparatus having a pivotal trigger member actuable to pivot a shaft member through a ratchet mechanism, the shaft member supporting a disc housing, configured for retaining a gear mechanism therein, the housing supporting first and second hair clamp members rotatable relative to the housing by means of the gear mechanism. Actuation of the trigger member with the housing restrained rotates both clamp members and the filaments of hair therein to twist the filaments into strands. Actuation of the trigger member with the housing released interchanges the positions of the clamp members in a direction opposite to the twist to produce a twine.

13 Claims, 6 Drawing Figures

HAIR TWINING APPARATUS

CROSS-REFERENCE TO RELATED APPLICATION

This application is a continuation of a U.S. patent application, Ser. No. 367,483, filed Apr. 12, 1982, now abandoned entitled "Hair Braiding Apparatus", by Jurgis Sapkus, and assigned to the assignee of the instant application. This application is related, in subject matter, to U.S. Pat. No. 4,369,690 issued to Jurgis Sapkus, the present applicant, on Jan. 25, 1983 and assigned to Mattel, Inc., the assignee of the instant application.

BACKGROUND OF THE INVENTION

The background of the invention will be discussed in two parts;

1. Field of the Invention

This invention relates to hair twining apparatus, and more particularly to hand operated hair twining apparatus for use with human or synthetic hair.

2. Description of the Prior Art

Braiding machines have been used extensively in the textile industry. Such braiding machines are shown and described, for example, in U.S. Pat. Nos. 352,804, issued Nov. 16, 1886 to Bowerson; 433,855, issued Aug. 5, 1890 to Ellis; 830,137, issued Sept. 4, 1906 to Diss; 1,398,444, issued Nov. 29, 1921 to Pfrunder; Re. 15,909, issued Sept. 2, 1924 to Pfrunder; 1,900,310, issued Mar. 7, 1933 to Somerville; 2,254,895, issued Sept. 2, 1941 to Johnston, Jr.; 2,782,590, issued Feb. 26, 1957 to Lowe; 2,878,514, issued Mar. 24, 1959 to Nichols et al; 3,360,915, issued Jan. 2, 1968 to Franzen; 3,421,406, issued Jan. 14, 1969 to Mitchell et al; 3,439,486, issued Apr. 22, 1969 to Klein; 3,552,693, issued Jan. 5, 1971 to Scherf; 3,834,146, issued Sept. 10, 1974 to Nessler, et al; and 4,262,479, issued Apr. 21, 1981 to Lenorak. Another similar type of device intended for use with wire is shown and described in U.S. Pat. No. 359,409, issued Mar. 15, 1887 to Stone.

Such prior art braiding machines for use in creating yarn, for example, are simply twisting machines. Other such devices for use in forming rope or cord ordinarily employ means for simply interweaving two strands. Other such devices for use in the textile industry tend to be complicated apparatus, part of an overall machine, with complex mechanisms.

A braiding machine intended specifically for hair is shown and described in U.S. Pat. No. 4,038,996 issued Aug. 2, 1977, to Eronini, et al. The hair braider apparatus of that patent is a portable hair braider which is motor operated, and uses a plurality of foot members for hair parters to divide the hair over a predetermined width of the scalp, with hair grabbers then clamping the hair thus-parted and rotating the strands for weaving them together to form a braid.

Another braiding machine intended for use with hair is shown and described in U.S. Pat. No. 4,307,737, issued Dec. 29, 1981 to Shipman. In the apparatus of this patent, three strands of hair are drawn through three elongated tubes mounted for movement within an elongated cylindrical housing, having an operating lever extending out through a slot in the surface thereof. The tubes are intermittently alternated by the operator, a pair at a time, by means of guide members positioned within a central opening. The three tubes are movable along a track passing through the guide members for alternately selecting a pair of tubes for rotation.

It is an object of the present invention to provide a new and improved hair twining apparatus.

It is another object of the present invention to provide a new and improved hair twining apparatus which is hand operated.

It is still another object of the present invention to provide a new and improved hair twining apparatus which is mechanically uncomplicated and usable by a child of tender years for twining human hair or synthetic hair, such as a doll's hair.

SUMMARY OF THE INVENTION

The foregoing and other objects of the invention are accomplished by providing a hair twining apparatus having a device for twisting a plurality of hair filaments into a strand and for intertwining a plurality of strands into a twine. A pair of clamps may be used to clamp two groups of hair filaments which may be rotated about their major axes to form a pair of strands; the clamps may then be orbited about an axis parallel to, and intermediate of, these major axes.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
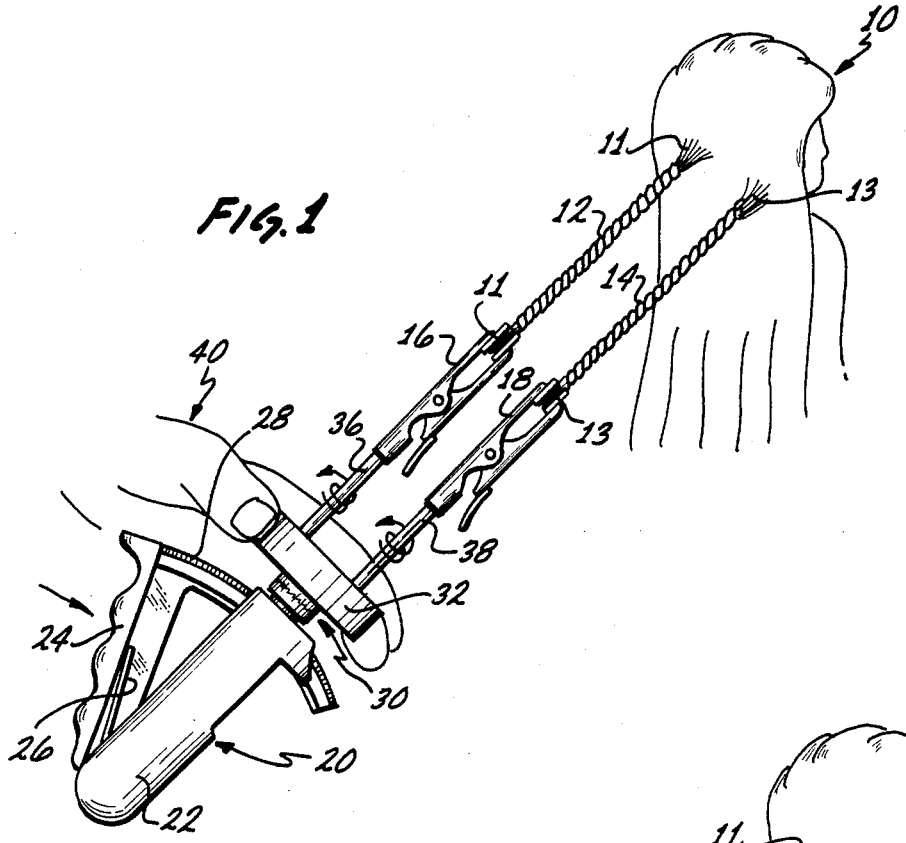
FIG. 1 is a perspective view of the hair twining apparatus of the invention illustrating the operation thereof while twisting a plurality of hair filaments to form strands.
Figure 2:
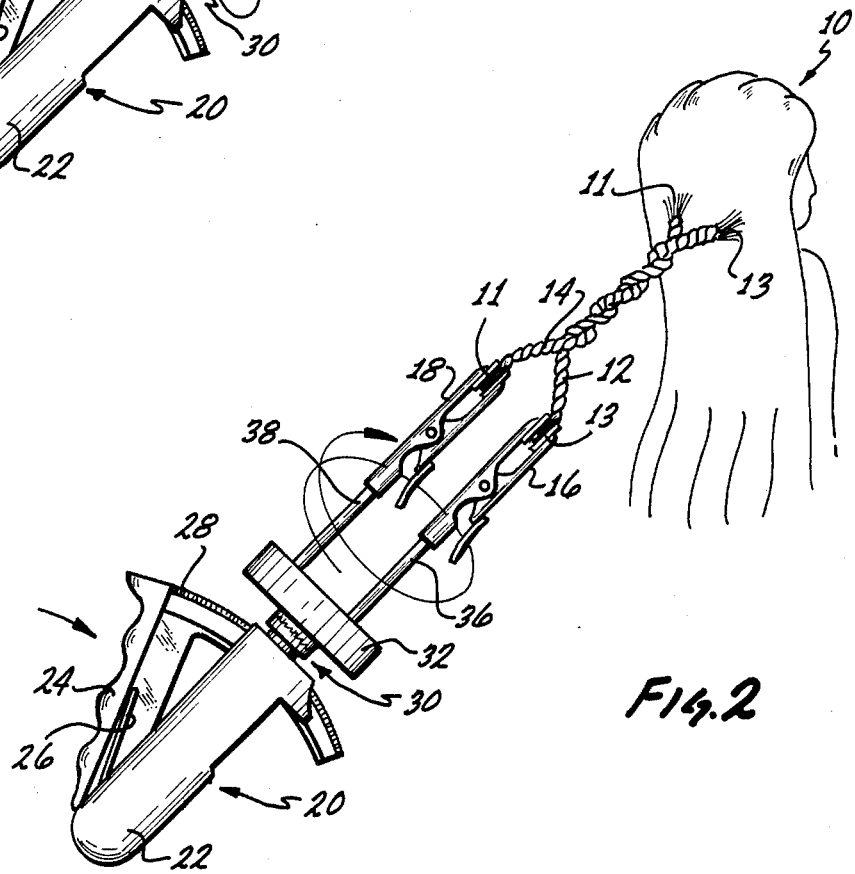
FIG. 2 is a perspective view similar to FIG. 1 depicting the operation of the apparatus intertwining the strands.

Referring now to the drawings, and particularly to FIGS. 1 and 2, there is shown a head 10 of a human or doll, with first and second groups of hair filaments 11, 13 which may be twisted into strands 12, 14, respectively, after being received within first and second clamp members 16 and 18 of a hair twining apparatus, generally designated by the reference numeral 20.

Apparatus 20 is configured for being hand held and hand operated, with the apparatus including a supporting structure or handle 22, pivotally receiving an actuating member or trigger 24 positioned for holding and actuating by one hand of the operator. As will hereinafter be described, the trigger 24, during operation, is repeatedly "pumped" against the force of a spring 26 abutting against the handle 22 and the trigger member 24. The portion of the trigger member 24 remote from the pivot is configured to form an arcuate rack 28 which coacts with a gear member to rotate a shaft coupled through a one way clutch or ratchet mechanism 30 to selectively rotate a disc housing 32 to ultimately provide the required movement of the clamp members 16 and 18.

Prior to a detailed description of the hair twining apparatus 20, a description of the operation will be provided with reference to FIGS. 1 and 2. Structurally, the hair clamp members 16 and 18 (in the form of "alligator clips") have generally parallel shaft projections 36 and 38 which are coupled to gear members of a gear mechanism within the housing 32, thus enabling the clamp members 16 and 18 to be rotated relative to each other and relative to the housing 32. With the housing being rotatable relative to the handle 22, the positions of the clamp members 16 and 18 are interchangable. By reference to FIG. 1, the groups of filaments 11, 13 are clamped at the ends thereof within the clip portions of the clamp members 16 and 18, respectively. The operator then may apply a suitable frictional restraining force to housing 32 with one hand 40 or other suitable means (not shown) to restrain housing 32 against rotation. Then, with the other hand (not shown), the operator may grasp the handle 22 and squeeze trigger member 24 to pivot the trigger member 24 toward the handle 22 against the force of the spring 26, with the clamp members 16 and 18 rotating simultaneously in the same direction (as indicated by the arrows encircling the shafts 36 and 38, respectively). With disc housing 32 stationary, the clamp members thus rotate relative to the housing 32. This motion twists the individual groups of hair filaments 11, 13 to form strands 12 and 14. With the trigger member 24 released to return under force of the spring 26 (and with the housing 32 restrained), the ratchet mechanism 30 disengages to permit this reverse travel of the trigger member 24. The trigger member 24 is then repeatedly squeezed until the desired twist of the strands 12 and 14 is obtained.

Referring now to FIG. 2, after the desired twist is obtained, the housing 32 is released and is now free to rotate relative to the handle 22. When the trigger member 24 is pivoted relative to the handle 22, the housing 32 then rotates 180° in a direction opposite to the direction of twisting (as indicated by the arrow encircling the clamp members) to interchange the positions of the clamp members 16 and 18 relative to the handle 22 by orbiting the clamp members 180°. After the trigger is depressed through one full cycle, and prior to its release, the housing 32 is then grasped to retain the strands in the twined position. The housing is restrained from rotation until the trigger member has returned to its open position as shown in FIG. 2. The action is then repeated until the twine is formed.

As will be hereinafter be described, the gear mechanism within the housing 32 incorporates pawls or dogs to prevent untwisting of the strands 12 and 14 during the strand-forming operation.

By reference to FIGS. 3 through 6, the overall construction of the hair twining apparatus 20 will now be described. The handle 22 is generally hollow and includes and integrally formed stub 42 encircled by the coiled portion 25 of the spring member 26 which has one free end restrained by the inner wall of the handle 22 and the other free end urging against a ridge or shoulder portion of the trigger member 24. The opposite end of the handle 22 is configured for receiving a shaft 44 having one end thereof within an aperture 46 of a web 48 formed transversely within the handle 22. The other end of the shaft 44 has a gear member 50 secured thereto. Intermediate the ends of the shaft 44, there are (from left to right as viewed in FIG. 3) a compression spring 52 encircling the shaft 44; a unitary member 56 mounted for rotation relative to the shaft 44, the unitary member 56 having a driven gear portion **56*a* and a ratchet portion 56*b*; a second unitary member 58 rotatably mounted on shaft 44, the second unitary member 58 having a ratchet portion 58*a* and a gear portion 58*b*, with these parts being retained on shaft 44 between the ends by the shaft gear 50 and a keeper 60 on the opposite end. Within the housing 32, the shaft projections 36 and 38 of the clamp members 16 and 18 have secured to the ends thereof first and second gear members 66 and 68, respectively. The gear members 66 and 68 meshingly engage the main drive gear portion 58*b* of the second unitary member 58 (see also FIG. 4). The gear members 66 and 68 have the shaft projections 36 and 38, respectively, extending therethrough for providing bearing support connections to the housing 32**.

Figure 4:
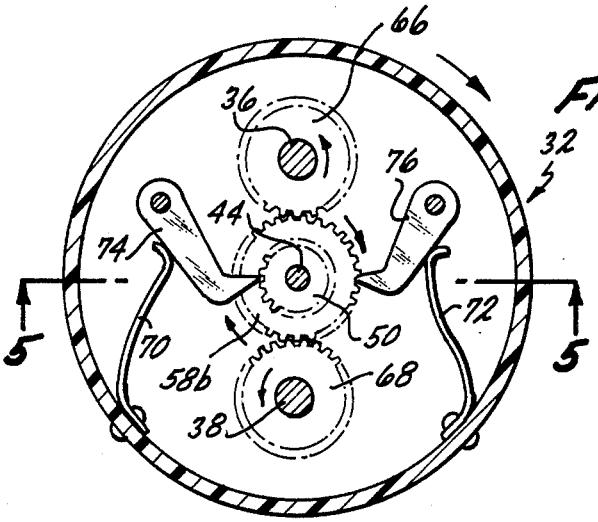
FIG. 4 is a cross-sectional view of a portion of the apparatus of FIG. 3, as viewed generally along line 4—4 thereof.
Figure 6:
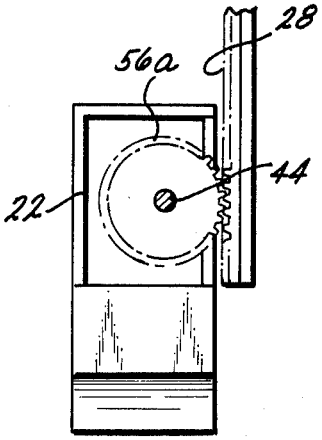
FIG. 6 is a partial cross-sectional view of the apparatus of FIG. 3, as viewed generally along line 6—6 thereof.

Functionally, the compression spring 52 urges the ratchet portions **56*b* and 58*a* into coaction during rotation of the driven gear portion 56*a* for concurrent movement, while permitting separation of the ratchet portions during counter-rotation of the driven gear portion 56*a* (with the housing 32 restrained). For reasons which will become obvious, both the first and second unitary members 56 and 58 are mounted for rotation on the shaft 44, and only the shaft gear 50 is secured to the shaft 44. As illustrated in FIG. 4, the interior of the housing 32 is generally cup-shaped with a circular cross-section. First and second leaf spring members 70 and 72 are radially mounted within the housing 32, the leaf spring members 70 and 72 having the first ends thereof secured to the interior wall of housing 32, and extending inwardly to abuttingly engage first and second pawl or dog members 74 and 76, respectively. Each of the dogs 74 and 76 is generally identically configured and pivotally mounted between the opposing top and bottom walls of the housing 32. The dog 74 is pivoted and urged into engagement with the shaft gear 50 by the leaf spring member 70, while the dog 76 is pivoted and urged into engagement with the drive gear portion 58*b* of the second unitary member 58 by the leaf spring member 72**.

As viewed in FIG. 4, when the shaft 44 and the shaft gear 50 rotate in a clockwise direction, the housing 32 will be forced to rotate in a clockwise direction (as indicated by the arrows adjacent the gear 50 and the housing 32). With the housing 32 restrained and the shaft gear 50 rotating in the counter-clockwise direction (with the trigger member returning to its unpivoted position) the shaft gear 50 is free to rotate with the dog 74 riding over the teeth thereof.

Similarly, with the housing restrained, the main drive gear portion **58*b* rotating in a clockwise direction (as indicated by the arrow adjacent thereto), the clamp member gears 66 and 68** are rotated, both in the counter-clockwise direction (as indicated by the arrows thereon), this action occurring when the twisting operation is being effected. This operation and the reason will become apparent hereafter during explanation of the use of the apparatus.

Figure 3:
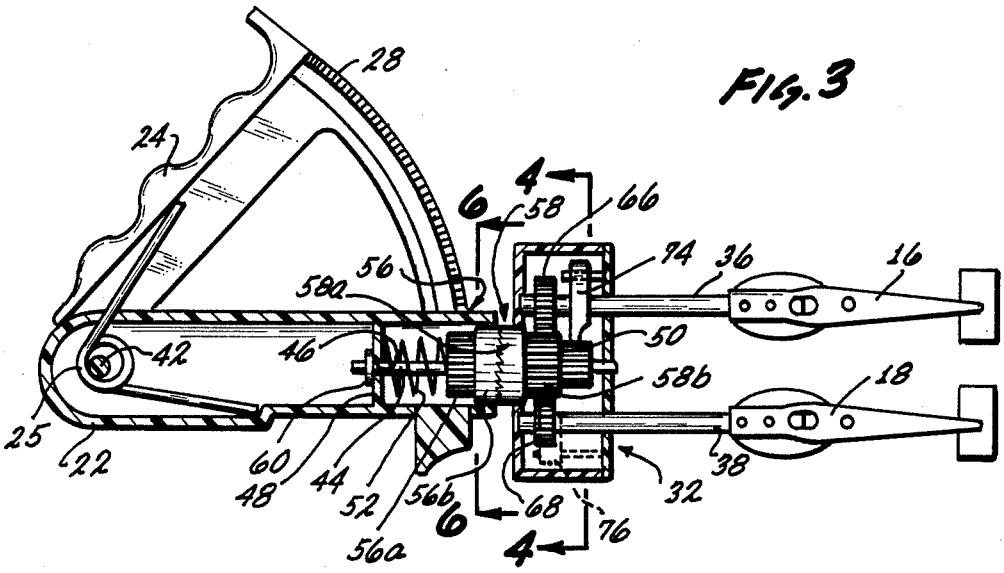
FIG. 3 is a plan view of the apparatus of FIG. 1, partially in cross-section, and partially broken away.
Figure 5:
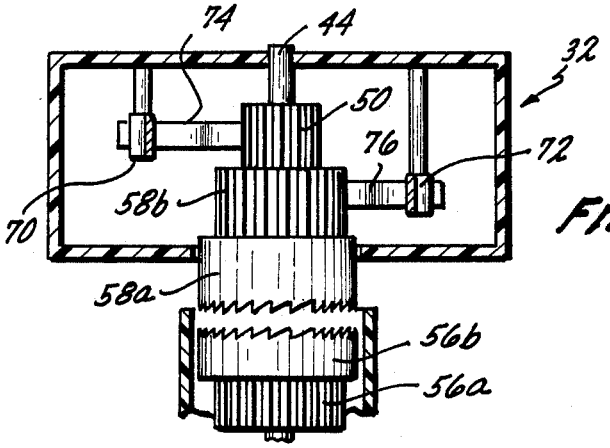
FIG. 5 is a cross-sectional view of a portion of the mechanism of FIG. 4, as viewed generally along line 5—5 thereof.

The relative axial positions of the dogs 74 and 76 is better illustrated in FIGS. 3 and 5 wherein it can be seen that the dogs 74 and 76 are positioned to be in alignment with the respective shaft gear 50 and drive gear portion **58*b*. As shown in FIGS. 3 and 5 the rack 28 coacts with the driven gear portion 56***a* of the first unitary member 56.

For purpose of explanation of the use and operation of the apparatus 20, the operation will be described first with reference to the twisting of filaments 11, 13 to form strands 12, 14 (as previously discussed with reference to FIG. 1), and then with respect to the twining of the strands (as previously discussed with reference to FIG. 2).

Referring now to FIGS. 1 and 3, with the hair filaments 11, 13 secured within clamp members 16 and 18, and the housing 32 restrained from operation (as shown in FIG. 1), the trigger member 24 is then pivoted against the force of the spring 26. During this movement of the trigger member 24, as shown in FIGS. 3 and 5, the rack 28 drives the first unitary member 56 in a clockwise direction (as shown in FIG. 4) which rotation is imparted to the second unitary member 58 through the ratchet mechanism 30 (consisting of parts 56*b* and 58*a*) to rotate the main drive gear portion 58*b* in a clockwise direction, as viewed in FIG. 4. During this rotation, the dog 76 rides over the teeth of the drive gear portion 58*b* while the dog 74 engages the teeth of shaft gear 50. The gears 66 and 68 then both rotate in the counter-clockwise direction simultaneously to twist the filament groups 11, 13, respectively, forming strands 12, 14 (as illustrated in FIG. 1). Upon release of the trigger member 24, and with the housing 32 restrained, the drive gear portion 58*b* wants to rotate counter-clockwise, but this action is inhibited by virtue of the dog 76 detenting within the gear teeth thereof, thus maintaining the gear portion 58*b* stationary, along with gears 66 and 68. Upon the next pivoting of the trigger member 24, this action is repeated until the strands 12 and 14 have the desired amount of twisting. During reverse travel of the trigger member 24, the portion 56*b* of the ratchet mechanism 30 is axially displaced against the force of the compression spring 52 to permit movement of the rack 28 without corresponding movement of the drive gear portion 58*b*.

In the twining operation, trigger 24 is pivoted with the housing 32 unrestrained. With the compression spring 52 urging against the first and second unitary members 56 and 58, the drive gear portion 58*b* is urged into abutting frictional engagement with the adjacent surface of the shaft gear 50 to thus provide a friction clutch engagement to urge shaft gear 50 into rotation concurrently with drive gear portion 58*b* upon actuation of the trigger member 24 against the force of its bias. With reference to FIG. 4, as the shaft gear 50 rotates clockwise, the engagement of the teeth thereof with the dog 74 urges the housing 32 into clockwise rotation to interchange the positions of the gears 66 and 68, and consequently orbit clamp members 16, 18 approximately 180° about an axis parallel to, and intermediate of, the major axes of the clamp members to intertwine strands 12, 14, as shown in FIG. 2. During reverse movement of the trigger member 24, the housing 32 is again restrained from rotation by a suitable frictional force, such as by manual grasping to thus keep the twined strands in position pending the next actuation of the trigger member 24.

With the action thus described, the hair filaments 11, 13 are twisted into strands 12 and 14 in a first direction with the twining of the strands taking place in the opposite direction. This counter-action assists in maintaining the twine in place with the apparatus removed after completion of the twining operation.

The apparatus hereinabove described is simple in construction, economical in manufacture and can be readily used by a child for achieving a braided effect on human or synthetic hair. While there has been shown and described a preferred embodiment, it is to be understood that various other adaptations and modifications may be made within the spirit and scope of the invention.

I claim:

1. In the hair twining apparatus, the combination comprising:

handle means configured for being hand held;

trigger means pivotally coupled to said handle means, said trigger means being spring biased in one direction for manual operation against the force of the bias;

a shaft coupled to said handle means;

a clutch disposed around said shaft;

means operably engaging said clutch for twisting a plurality of groups of hair filaments into strands and intertwining said strands into a twine upon actuation of said trigger means; and first and second unitary members rotatably received on said shaft, said first unitary member having a gear operably engaging said trigger means as a first portion thereof and a part of said clutch as a second portion thereof, and said second unitary member having another part of said clutch as a first portion thereof and a drive gear member as a second portion thereof, said drive gear member being a part of said means for twisting and intertwining.

2. In a hair twining apparatus, the combination comprising:

handle means configured for being hand held;

trigger means pivotally coupled to said handle means, said trigger means being spring biased in one direction for manual operation against the force of the bias;

shaft means coupled to said handle means;

gear means on said shaft means coacting with said trigger means for rotation in response to actuation of said trigger means;

housing means on said shaft means;

clutch means on said shaft means intermediate said gear means and said housing means;

first and second spaced hair clamp means supported by said housing means, said clamp means being configured for gripping first and second groups of hair filaments; and means within said housing means coacting with said clutch means for enabling concurrent rotation of said first and second hair clamp means upon actuation of said trigger means with said housing means rotationally restrained for twisting the filament groups into strands, and for enabling interchanging of the positions of said first and second clamp means relative to said handle means upon actuation of said trigger means with said housing means unrestrained for twining said strands.

3. The combination according to claim 2 wherein said clutch means is a ratchet mechanism.

4. The combination according to claim 3 wherein said trigger means is a trigger member having a rack portion engaging said gear means on said shaft means.

5. The combination according to claim 4 wherein said first and second clamp means include first and second shaft projections extending into said housing means, and said means within said housing means includes gear members coupled to said first and second shaft projections.

6. The combination according to claim 5 wherein said apparatus includes first and second unitary members rotatably received on said shaft means, said first unitary member having said gear means on said shaft means as a first portion thereof and a part of said ratchet mechanism as a second portion thereof, and said second unitary member having another part of the ratchet mechanism as a first portion thereof and a drive gear member as a second portion thereof, said drive gear member being part of the means within said housing.

7. The combination according to claim 6 wherein said shaft means is a shaft member having an encircling spring abutting between a portion of said handle means and said first unitary member for urging the parts of the ratchet mechanism into engagement while permitting separation of the parts.

8. The combination according to claim 7 wherein said means within said housing means includes a gear member secured to the end of said shaft member and dog means pivotally coupled to said housing means and resiliently urged into engagement with said shaft gear member for providing concurrent rotation of said shaft member and said housing means in one direction.

9. The combination according to claim 8 wherein said gear members coupled to said first and second shaft projections meshingly engage said drive gear member for simultaneous rotation in the same direction of said clamp means, and said means within said housing further includes second dog means pivotally coupled to said housing means and resiliently urged into engagement with said drive gear member for providing concurrent rotation of said drive gear member and said housing means in a direction opposite to said one direction.

10. The combination according to claim 9 wherein said encircling spring urges the adjacent faces of said drive gear member and said shaft gear member into abutting frictional engagement.

11. The combination according to claim 2 wherein said means within said housing means includes gear means for rotating said first and second clamp means simultaneously in the same direction, and dog means coacting between said housing means and some of said gear means for enabling the interchanging of said first and second clamp means in a direction opposite to the direction of rotation of said clamp means.

12. The combination according to claim 11 wherein said first and second clamp means have shaft projections extending into said housing means with gear members secured thereto, said gear members being part of said gear means within said housing.

13. The combination according to claim 12 wherein said clutch means is a ratchet mechanism, part of which includes a drive gear member within said housing means meshingly engaging said gear members on said shaft projections.

* * * * *